US007493788B2

(12) United States Patent
Heffe et al.

(10) Patent No.: US 7,493,788 B2
(45) Date of Patent: Feb. 24, 2009

(54) DEEP ROLLING ROLLER HEAD FOR SPLIT-PIN CRANKSHAFTS

(75) Inventors: Roland Heffe, Korschenbroich (DE); Hans-Willi Lingen, Erkelenz (DE); Frank Risters, Erkelenz (DE); Hans Zimmermann, Selfkant (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 1201 days.

(21) Appl. No.: 10/752,417

(22) Filed: Jan. 5, 2004

(65) Prior Publication Data

US 2008/0184756 A1 Aug. 7, 2008

(30) Foreign Application Priority Data

Dec. 9, 2003 (DE) ..... 103 57 441

(51) Int. Cl.
*B21D 15/00* (2006.01)

(52) U.S. Cl. ..... 72/110

(58) Field of Classification Search ..... 72/107, 72/110; 29/6.01

See application file for complete search history.

(56) References Cited

U.S. PATENT DOCUMENTS

| | | | | |
|---|---|---|---|---|
| 5,445,003 | A | 8/1995 | Gottschalk et al. | 72/110 |
| 5,495,738 | A * | 3/1996 | Gottschalk | 72/110 |
| 5,575,167 | A * | 11/1996 | Gottschalk et al. | 72/110 |
| 7,168,278 | B2 * | 1/2007 | Derichs | 72/110 |

FOREIGN PATENT DOCUMENTS

| | | |
|---|---|---|
| EP | 0661137 | 7/1995 |

* cited by examiner

*Primary Examiner*—Edward Tolan
(74) *Attorney, Agent, or Firm*—Proskauer Rose LLP

(57) ABSTRACT

A deep rolling roller head includes two housings for the deep rolling of the outer radii or fillets of split-pin crankshaft journals by means of two deep rolling rollers which are pressed into one of the two fillets under a rolling force while the crankshaft rotates around its axis of rotation. The two housings follow at the same time the different movements of the journals and support each other with their insides across from each other on a bearing plate. The insides of the housings bear on either side of the axis of rotation of the crankshaft and at a distance from it on an extension segment extending in the direction of the rolling force to below a contact point between the deep rolling rollers and the fillets to be deep-rolled. The bearing plate connected permanently to the inside and the extensions of one of the two housings.

10 Claims, 2 Drawing Sheets

DEEP ROLLING ROLLER HEAD FOR SPLIT-PIN CRANKSHAFTS

RELATED APPLICATIONS

This application claims the benefit of and priority to German Patent Application No. DE 103.57.441.7, filed on Dec. 9, 2003, the disclosure of which is incorporated herein by reference in its entirety.

FIELD OF THE INVENTION

The present invention relates to a deep rolling roller head with two housings for the deep rolling of the outer radii or fillets of split-pin crankshaft journals by means of two deep rolling rollers each of which is pressed into one of the two radii or fillets by a rolling force while the crankshaft rotates around an axis of rotation, whereby the housings follow the different movements of the journals and bear upon each other on a supporting element with their insides facing each other, whereby each deep rolling roller bears upon a guide roller that is mounted inside its respective housing so as to be capable of axial and radial rotation.

BACKGROUND OF THE INVENTION

The English language term "split-pin" is also known to the German person schooled in the art. This is understood to be a crankshaft for a multi-cylinder combustion engine whose cylinders may be arranged e.g. in V formation, so that the crankshaft is provided with journals offset at an angle and adjoining each other.

Deep rolling tools for the deep rolling of the outer radii or fillets of crankshafts of the above-mentioned type are known e.g. from U.S. Pat. No. 5,575,167 or from EP Patent 0 661 137 B1.

The known deep rolling tools have two housings independent of each other in which deep rolling rollers are rotatably mounted and are pressed by the rolling force respectively into one of the two outer radii or fillets of a split-pin journal. At the same time the crankshaft rotates around its axis of rotation and the housings follow the different movements of the split-pin journals independently of each other. At the same time the housings bear with their flat inner walls upon each other with a supporting element installed between the flat inner walls of the housings. The support is necessary because the reaction forces transmitted by the rolling force from the deep rolling rollers to the housings of the deep rolling roller head must be absorbed. In the case of the first-named US patent the supporting element consists of a pair of ring-shaped flat bearing plates made of teflon, nylon or some other suitable plastic material with good sliding characteristics and low tendency to wear. In the case of the EP patent the supporting element consists of a ring-shaped thrust-bearing unit with cage, installed between the tool housings. The ring-shaped thrust-bearing unit maintains the alignment of the tool housings in parallel vertical planes while the latter are rotated relative to each other around the axis of a motor crankshaft or while the motor crankshaft rotates under the tool housings. It is therefore very important for the thrust-bearing unit to absorb and eliminate the resulting lateral pressure forces produced during the rolling process by the deep rolling rollers opposite of each other and inclined to the outside.

Since the deep rolling rollers are however "shackled" in the axial direction of the crankshaft by the crank arms delimiting the radii or fillets, reactions occur in the upper area of the housing of the deep rolling roller heads, i.e. the area away from the crankshaft. This area has the tendency to gape apart under the deep rolling force. The gaping apart renders the deep rollers uncontrollable and leads to unsatisfactory results.

For this reason measures have already been taken to provide clamping arrangements on the deep rolling devices of which the deep rolling roller heads are a part, their purpose being to suppress the gaping apart of the housings of the deep rolling roller heads. The EP patent describes such a solution (see EP 0 661 137, p. 1, col. 2, lines 4-15, col. 8, lines 18-21 and FIG. 4C).

The means known so far for the suppression of the gaping apart phenomenon are however too far away from the location of that occurrence because of design constraints, so that they cannot be an effective remedy. Due to the natural elasticity of the deep rolling devices in the axial direction of the crankshaft, narrow limitations are imposed on reinforcement by means of clamps.

SUMMARY OF THE INVENTION

This leads to the problem to be solved by the present invention, i.e. to provide a simple, secure and economical support for the housings of the deep rolling roller heads.

This problem is solved in that each of the insides of the housings is provided with an extended segment on either side of the rotational axis of the crankshaft and at a radial distance from it, extending in the direction of the rolling force until below the contact point between the deep rolling rollers and the radii or fillets to be deep rolled, and in that the supporting element is made in form of a sliding surface that is permanently connected to the inside and the extensions of one of the two housings.

In this manner the housings of the deep rolling roller heads receive additional support in an area located below the contact point between the deep rolling roller and the crankshaft, as seen in direction of the rolling force. Hereby the gaping of the upper regions of the housing of the deep rolling roller head can be effectively prevented under the effect of the deep rolling force. It is advantageous if the supporting areas are extended in the direction of the rolling force up to the level of the axis of rotation of the crankshaft and, insofar as the design conditions permit, even beyond this.

By extending the supporting forces under the action of the deep rolling rollers on the crankshaft it is even possible to leave the bearing surface around this area open to a great extent. A circular opening, concentric with the main rotational axis of the crankshaft has proven itself here.

The supporting surface according to the invention is made of a material with good sliding characteristics. Materials of this type are for instance those that contain nylon, Teflon or carbon, in particular of the kind containing graphite. Material with portions of the above-mentioned materials is also suitable.

In addition to the insides of the housing of the deep rolling roller heads made of steel, brass has been found to be especially well suited as a material for the bearing surface. Brass is known to have better sliding characteristics than steel. Screw connections are provided for attachment to the inside of one of the two housings of the deep rolling tool, but pins can be used just as well or the bearing surface can be bonded to the inside of one of the two housings.

Furthermore, openings in the form of lubrication channels are provided on the surface of the brass bearing surface towards the inside of the opposite housing of the deep rolling tool. An outlet through which additional lubricants such as grease, oil or graphite can be supplied to the openings on the outside of the bearing surface is installed on a lateral face of the housing concerned.

To improve the support of the guide rollers on which the deep rolling rollers bear within the housing, an axial bearing in form of a radial needle bearing is provided in addition to those provided in the state of the art.

BRIEF DESCRIPTION OF THE DRAWINGS

The invention is described in greater detail below through an example of an embodiment. At a reduced scale.

DETAILED DESCRIPTION OF THE INVENTION

Figures 1, 2:
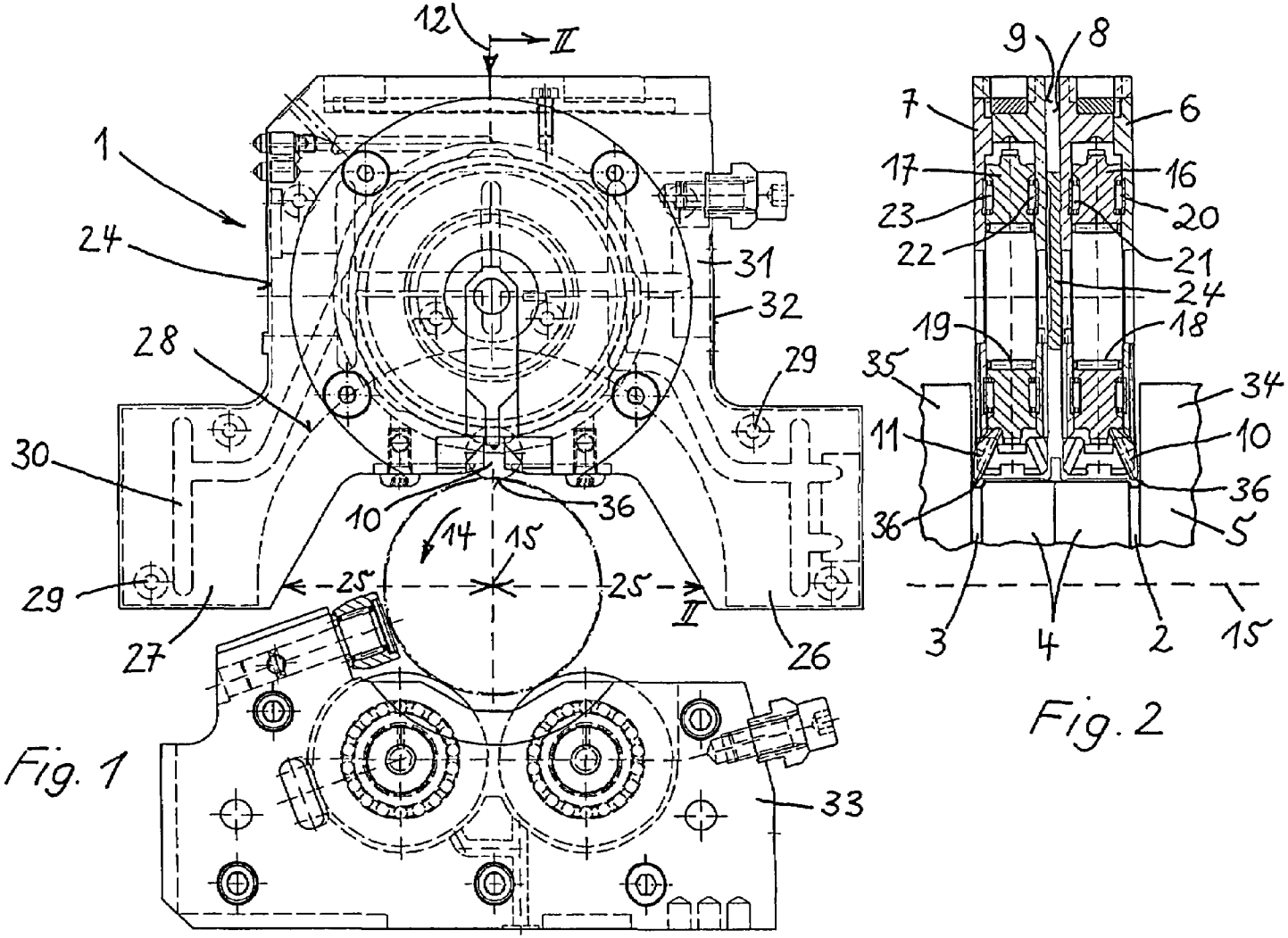
FIG. 1 shows a deep rolling tool in a side view.
FIG. 2 shows a longitudinal section through the deep rolling tool of FIG. 1 along line II-II and FIG. 3 shows the forward segment of a deep rolling device in a side view.
Figure 3:
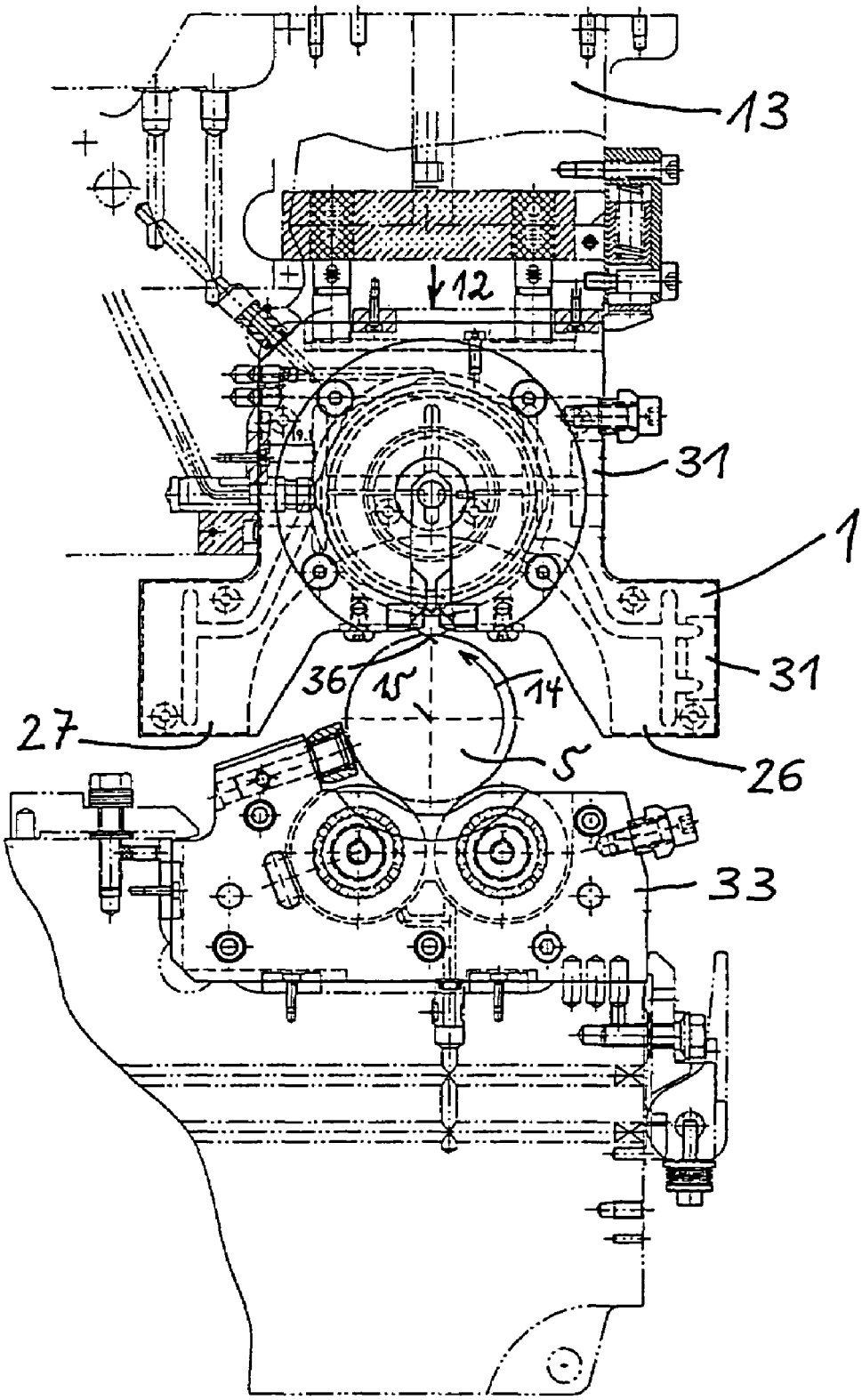

The deep rolling roller head 1 for the deep rolling of fillets 2 and 3 on the split-pin journal 4 of a crankshaft 5 is provided with two housings 6 and 7 the insides 8 and 9 of which are turned towards each other. The deep rolling of the fillets 2 and 3 is achieved by means of deep rolling rollers 10 and 11 acting under a deep rolling force 12 exerted by the deep rolling machine 13 on the housings 6 and 7 of the deep rolling roller head 1. During deep rolling the crankshaft 5 rotates in the direction of arrow 14 around its main axis of rotation 15 that extends at a perpendicular to the plane of the drawings in FIGS. 1 and 3. FIGS. 1 to 3 show this process in a simplified mostly schematized manner.

The deep rolling rollers 10 and 11 in turn bear on guide rollers 16 and 17 that are respectively mounted rotatably in one of the housings 6 or 7 on radial bearings 18 and 19 and axial bearings 20 to 23.

A bearing plate 24 is provided between the insides 8 and 9 of the housings 6 and 7. In FIG. 1 the bearing plate 24 is indicated by broken lines. On either side of the axis of rotation 15 and at a radial distance 25 from it, the two insides 8 and 9 are extended by segments 26 and 27 which extend respectively vertically as far as below the axis of rotation 15, vertically as seen in the direction of the rolling force 12. The bearing plate 24 follows the contours of the two extended segments 26 and 27 but is cut out above the deep rolling rollers 10 or 11 in an arc of circle 28 whose central point in turn constitutes the axis of rotation 15 in this case. It should be noted that either of the two insides 8 and 9 and the bearing plate 24 have the configuration shown in FIGS. 1 and 3, i.e. each with an extension segment 26 or 27.

The bearing plate 24 is attached on the inside 8 of the housing 6 by suitable means such as e.g. screws 29 or pins. On its upper side, facing the inside 9 of the housing 7 across from it, the bearing plate 24 is provided with recesses 30 in the form of channels. The recesses 30 let out in a zone 31 on one of the faces 32 of the housing 7. A lubricant can be supplied from outside the deep rolling machine 13 through the outlet 31 to the channel-shaped recesses 30. For the sake of completeness, the supporting roller head 33 serving to support the crankshaft 5 during deep rolling is shown below the deep rolling roller head 1.

In FIG. 2 the crankshaft 5 with its two adjoining split-pin journals 4 is shown and is delimited in the direction of the main axis of rotation 15 by the crank arms 34 and 35. The fillets 2 and 3 that are deep-rolled by means of the deep rolling roller head 1 are located between the splint-pin journals 4 and the crank arms 34 and 35. For this purpose the deep rolling rollers 10 and 11 enter the fillets 2 or 3 and roll them respectively at a point of contact (i.e., contact point 36).

LIST OF REFERENCE NUMBERS

1 Deep rolling roller head
2 Fillet
3 Fillet
4 Split-pin journal
5 Crankshaft
6 Housing
7 Housing
8 Inside
9 Inside
10 Deep rolling roller
11 Deep rolling roller
12 Rolling force
13 Deep rolling machine
14 Direction of rotation
15 Main axis of rotation
16 Guide roller
17 Guide roller
18 Radial bearing
19 Radial bearing
20 Axial bearing
21 Axial bearing
22 Axial bearing
23 Axial bearing
24 Bearing plate
25 Distance
26 Extension segment
27 Extension segment
28 Arc of circle
29 Screws
30 Opening
31 Outlet
32 Face
33 Supporting roller head
34 Crank arm
35 Crank arm
36 Contact point

The invention claimed is:

1. Deep rolling head with two housings for the deep-rolling of outer radii or fillets of split-pin crankshaft lobes by means of two deep rolling rollers being pressed respectively into one of the two radii or fillets under roller force, while the crankshaft rotates around an axis of rotation, the two housings following simultaneously different movements of the journals and bear with their insides facing each other on a supporting element, whereby each of the deep rolling rollers is supported on a guide roller inside the corresponding housing so as to be rotatable in axial and radial direction, wherein the insides of the housings are each provided with an extension segment on either side of the axis of rotation of the crankshaft and at a radial distance from it, extending in a direction of a rolling force to below a contact point between the deep rolling rollers and the radii or fillets to be deep-rolled, and in that the supporting element is made in form of a sliding surface that is permanently connected to the inside and the extension of one of the two housings.

2. Deep rolling roller head as in claim 1, wherein at least one of the two extension segments across from each other of the two insides of the two housings extends in the direction of the rolling force to at least a level of the axis of rotation of the crankshaft.

3. Deep rolling roller head as in claim 1, wherein the supporting element is open above the contact point.

4. Deep rolling roller head as in claim 3, wherein the supporting element is open in a circular form concentrically with the axis of rotation of the crankshaft.

5. Deep rolling roller head as in claim 1, wherein the supporting element is made of a material having good sliding characteristics.

6. Deep rolling roller head as in claim 5, wherein the material of the supporting element is made of nylon, Teflon, or carbon.

7. Deep rolling roller head as in claim 5, wherein the material of the supporting element is made of brass.

8. Deep rolling roller head as in claim 1, wherein the supporting element is attached by screws, bolts or adhesive to the insides of the two housings and to their extension segments.

9. Deep rolling roller head as in claim 8, wherein the supporting element is provided with openings on a surface towards the inside of one of the two housings, the openings let out in a face of one of the two housings to the inside of which the supporting element is connected.

10. Deep rolling roller head as in claim 1, wherein the guide roller of at least one of the two housings is supported by an axial bearing across from its inside.

* * * * *

UNITED STATES PATENT AND TRADEMARK OFFICE

CERTIFICATE OF CORRECTION

PATENT NO. : 7,493,788 B2
APPLICATION NO. : 10/752417
DATED : February 24, 2009
INVENTOR(S) : Heffe It is certified that error appears in the above-identified patent and that said Letters Patent is hereby corrected as shown below:

In claim 1, column 4, line 44, delete “lobes” and replace it with -- journals --

Signed and Sealed this

Twenty-first Day of April, 2009

John Doll

JOHN DOLL
*Acting Director of the United States Patent and Trademark Office*